United States Patent [19]

Sergeant

[11] Patent Number: 4,900,094

[45] Date of Patent: Feb. 13, 1990

[54] ADJUSTABLE PLUNGE-CUT ROAD SAW MECHANISM

[76] Inventor: Mark R. Sergeant, 73 Tower Hill Ave., Red Bank, N.J. 07701

[21] Appl. No.: 305,844

[22] Filed: Feb. 2, 1989

[51] Int. Cl.[4] ..... E01C 23/09

[52] U.S. Cl. ..... 299/39; 51/176; 404/90; 404/94

[58] Field of Search ..... 299/36, 39, 81; 404/90, 404/91, 94; 51/176

[56] References Cited

U.S. PATENT DOCUMENTS

| | | | |
|---|---|---|---|
| 3,778,110 | 12/1973 | Staab | 51/176 X |
| 3,779,607 | 12/1973 | Staab | 51/176 X |
| 4,174,184 | 11/1979 | Heenan | 404/94 X |
| 4,463,989 | 8/1984 | Kennedy | 299/39 |

*Primary Examiner*—Stephen J. Novosad

*Assistant Examiner*—David J. Bagnell

*Attorney, Agent, or Firm*—Charles F. Gunderson

[57] ABSTRACT

A heavy vehicle has fixed cross braces mounted on its frame perpendicular to the direction of the vehicle, and close to the surface of a road. Movable cross braces fit within these fixed cross braces, and support a circular cutting tool that can be extended, laterally, to line up with a guide line on the surface of the road, and that pivots up and down to cut into the surface of the road. An additional pivot permits the circular cutting tool to be set level with the surface of the road before a cut is made. A water supply, with suitable nozzles directed at the cutting blades of the circular cutting tool, cools and lubricates the blades while they are cutting into the surface of the road. A source of compressed air with suitable nozzles, that can be directed at the newly cut holes in the surface of the road, cleans out the holes for the installation of safety reflectors.

8 Claims, 1 Drawing Sheet

ADJUSTABLE PLUNGE-CUT ROAD SAW MECHANISM

BACKGROUND OF THE INVENTION

As roadways and superhighways become more crowded, and traffic safety becomes more of a problem, all possible measures must be taken to make the highways as safe as possible. One of the measures that can be taken is to clearly define the separate traffic lanes. For example stripes are painted between the lanes to guide the cars within the lanes. These stripes may be solid, single or doubled, to indicate that no crossing is permitted, or dashed to indicate that vehicles may cross the line for passing etc.

However, at night, these stripes can be only dimly seen, and, with any amount of fog or precipitation, the stripes may be almost invisible, along with the road, making driving, potentially, quite hazardous. This situation can be enormously relieved by the use of "cats eye" reflectors along the road.

These reflectors can be mounted in the surface of the highway, and spaced at intervals along the edge, or along the center lanes, or both, to mark the lanes. The adaptation of "cats eye" reflectors along the roads provided a means for picking up the line of the center, or the edge, of the road very-much further ahead at night in clear weather, and especially, and more important, in foggy weather or in varying degrees of precipitation. These reflectors not only define a lane, or lanes, but also anticipate curves in the road ahead.

It is most advisable to expand the use of reflectors as much as practical along all of the lanes of all possible highways. However, there are practical problems in the installation of these reflectors. To begin with, there are many types, from a single reflector, to multiple reflectors.

The single reflectors require minimal mounting, and may be adequate where there is minimum wear or abrasion, as, for example, along the edges of a highway that car tires usually avoid. However, in the middle of the highway, where there will be, comparatively, much more traffic passing back and forth across the line of the reflectors, there is a need for more individual reflectors for visibility and redundancy, and they must sometimes face in both directions. This calls for larger units to accommodate more reflector elements, and, necessarily, larger and stronger bases, secured more deeply within the surface of the highway, and more resistant to wear, abrasion from car tires, and the inevitable risk of damage by snow plows and the like.

The larger and sturdier the unit, the more difficult it is to embed it within the pavement. The holes must be larger and, therefore, more difficult to cut, particularly through concrete, and the time and effort, and problems must increase with the size of the units, as well as the numbers of the units that must be installed.

The basic tool in use today for mounting the larger reflective units is a hand-held, motor-driven device with a plurality of circular blades with edges of material that are hard enough to cut into concrete, or any other highway surface material. These multiple blades act in a manner similar to a dado blade in wood; to provide a wide cut, of a fixed width. The cut can be made to a precise depth, within the surface of the road. The reflective insert must, obviously, have the same curvature, width, and depth as the cut to fit into the trench and be securely glued into the pavement. The reflectors must, of course, be on top and level with the pavement.

The hand-held, motor-driven device, or machine, is large and cumbersome and very difficult to control. It takes considerable skill to bring the machine into alignment with a given lane in the road, and hold it in that alignment for the entire cut. The machine, under enormous stress from the cutting blades, is pulling constantly away from its cut and from the operator. Aside from the strength and skill involved, this is, understandably, a very slow and tedious process, with only one cutter for each operator, and only his skill to achieve the right alignment and depth. His own weight and strength can do little to speed up the cutting process.

A further problem is heat and abrasive wear. Normally, when cutting a very hard material with an equally hard cutter, some liquid, such as water, is used to lubricate, and also cool, the cutter as well as the material being cut. This is seen, for example, in the classical whetstone used for sharpening scythes and other farm implements, where the lower part of a circular, rotating stone passes through a waterfilled trench before it reaches the edge of the tool being sharpened, or a can of water drips on the stone as it rotates.

However, with the hand-held, motor-driven device, this cutting process must be done dry, since it would be, physically impractical, if not unmanageable, to provide a water supply and dispenser for the hand-held cutter. An extra worker with a hose could be provided, but it would be messy, if not inefficient, to say the least. It would, undoubtedly, add to the discomfort and the confusion of the operator.

Aside from water to cool the pavement and the cutting blades, which may, or may not be practical, it is still necessary to clear as much as possible of the debris and dust out the holes, before the pre-formed reflective units are embedded and glued into the pavement. This clearing and cleaning can be done manually, but brooms or brushes must leave some dust or debris in the holes that could weaken the bond between the reflective unit and the pavement.

A more effective means for clearing out the hole, quickly and cleanly, would be to provide a blast of compressed air into the cut to clear out all of the debris and the dust, as well as water, if this has been used for cooling during the cutting. However, this would require an even-more bulky, heavy, and cumbersome attachment to the already-awkward manheld cutting device, or, again, another operator to perform this function.

It is therefore, and object of this invention to provide a machine for cutting holes in any pavement for the installation of safety, "cat's eye" reflectors.

It is a further object of this invention to provide a machine that is completely adjustable, and that can drop a cutter, in precise alignment and spacing, in a pavement to cut out a receptacle for a "cat's eye" reflector unit.

It is a further object of this invention to provide a cutter machine that can have much more power, and apply much more pressure than a single operator can control or apply, and that can cut the necessary holes in the pavement in a fraction of the time that would be required by a single operator.

It is a further object of this invention to provide a machine that can accommodate more than one cutter, to be uniformly spaced and make simultaneous cuts at proscribed intervals along a pavement.

It is a further object of this invention to provide a machine that can be adjusted to accommodate any sizes and depths of holes in a pavement for any purpose.

It is a further object of this invention to provide a machine that includes a water supply and hoses and nozzles to direct a stream of water at the cutters for lubricating and cooling as they cut into the pavement.

It is a further object of this invention to provide a machine that includes a source of compressed air, and hoses and nozzles to direct the compressed air into one of the newlycut holes to clear out all of the dust, debris, and water from the cutting operation, out of the slot to prepare it for the mounting of a reflective unit.

SUMMARY OF THE INVENTION

A machine for cutting holes in a pavement to accommodate "cat's eye" reflector units is mounted on a truck to move it from place to place, and align the cutters with the road. The mechanism includes a cross brace, mounted on a truck body, with girder members that can slide in and out, on either side of the truck body, to position the cutters along pre-marked lane lines in the road. The cutters are dropped, and energized to cut the necessary holes in the road to a prescribed depth for the reflectors. A supply of water under pressure is provided and nozzles are directed toward the cutting blades and pavement to cool and lubricate the blades. When the cut is finished, the cutters are withdrawn, and the water is turned off, and another nozzle directs air, under pressure, into the cut to blast out all of the debris, the dust, and the water, so that a preformed reflector unit can be fitted into and glued within the cut.

DETAILED DESCRIPTION OF THE DRAWINGS

Figure 1:
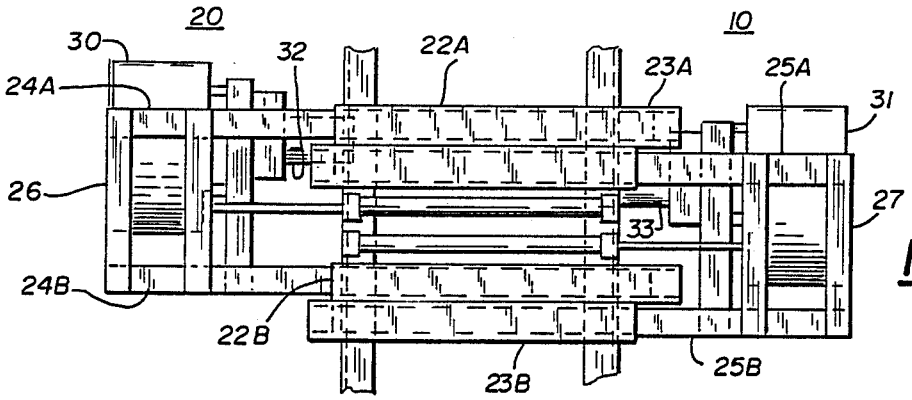
FIG. 1 shows a top view of a vehicle with cutters mounted on either side.

Referring now more particularly to FIG. 1 a top view is shown of a typical vehicle 10, supporting a mechanism 20 that includes rectangular members 22A and 22B, within which braces 24A and 24B can slide in and out to control the lateral position of a cross brace 26. Similar elements are seen on the other side with rectangular members 23A and 23B within which sliding braces 25A and 25B can slide in and out, supporting and controlling the position of cross brace 27.

Figure 2:
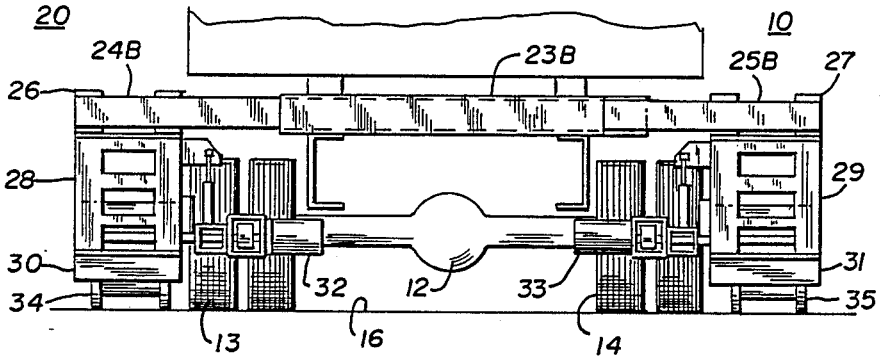
FIG. 2 shows an a front view of the same vehicle
Figure 4:
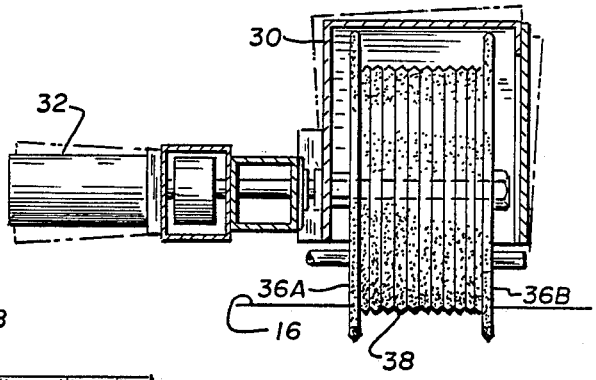
FIG. 4 shows a front view of this cutter.
Figure 3:
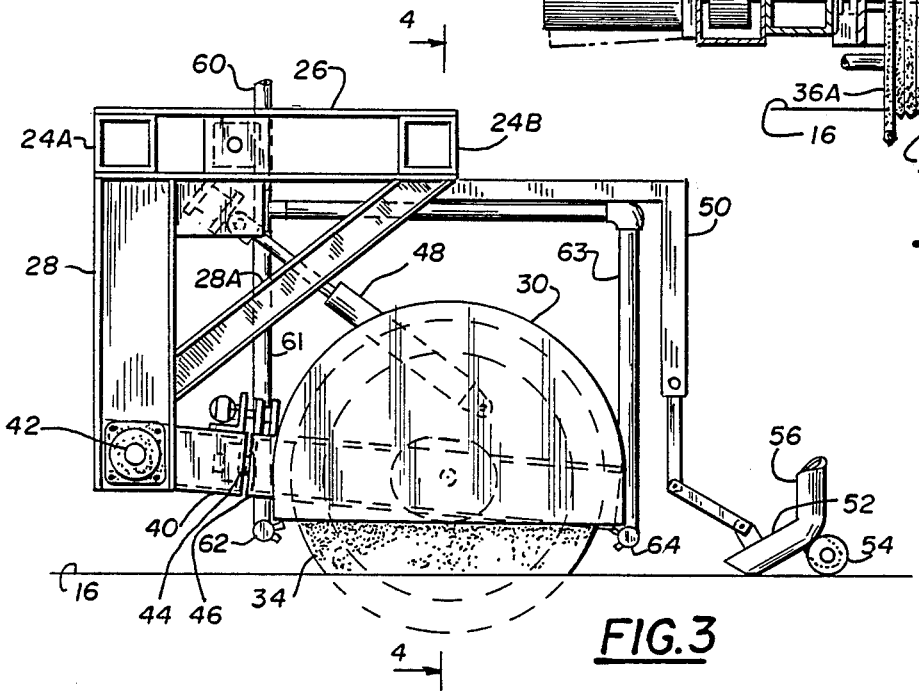
FIG. 3 shows an enlarged side view of one of the cutters.

The object here is to control the lateral motion of the cross braces 26 and 27 to bring them, and the plunge-cut saws, seen in FIGS. 2, 3, and 4, that they support, into alignment with specific parts of the road. The drive motors 32 and 33 are for the plunge-cut saws.

FIG. 2 shows a front view of the same vehicle 10 and the mechanism 20, with similar elements similarly numbered, as they will be in all of the figures. The vehicle chosen may have a single rear axle 12, but may have double wheels 13 and 14 to carry the load of this mechanism.

This figure shows, from a different angle, the rectangular members such as 23B. which support, and permit the sliding brace members 24B and 25B to slide in and out. The cross braces 26 and 27 support vertical braces 28 and 29, that, in turn, support the plunge cutters 30 and 31, with their drive motors 32 and 33, and their blades 34 and 35. This is all held above a pavement 16, that is to be cut for the installation of the reflective units.

It will be obvious that the plunge cut saws and their cutters 34 and 35 can be moved to any desired position, laterally, by movement of the corresponding arms 24 and 25. The alignment of the truck will assure the correct axial alignment with the road pavement.

FIG. 3 is a more detailed side view of a plunge cut saw and some of its bracing and accessories. Here a pivotable bracket 40; has a pivot 42 on brace 28. An adjustable arm 48, which may be hydraulically operated, controls the position of the plunge cut saw 30 and its cutters 34, in a vertical plane with respect to the pavement 16.

The cross brace 26 is also seen here, with its vertical support brace 28, as well as an additional diagonal brace 28A to help hold the plunge-cut saw support braces rigid during the operation.

A pivotable shaft or bearing 44 couples an extension 46 to the bracket 40, adding a second degree of motion to the plunge cut saw 30, this allows the saw to be levelled with the road in a horizontal plane.

This figure shows a typical water cooling system having an input 60 connected to a water tank, not shown, and supplying water to a pipe 61 connected to a nozzle 62 directing water at one end of the cutters 34. Another pipe 63, also supplied from input 60, is shown connected to another nozzle 64 directing water at the other end of the cutters, pressure for the water may be provided within the tank, or by gravity, or by pumps.

Actually, the water may be directed against the cutting blades from either end, as long as the cooling and the lubricating effect is achieved. However, for this cutter, the blades are abrasive and bi-directional. It is, therefore, desirable and advantageous to be able to reverse the rotation of the blades to clear the grit and present fresh cutting edges for improved efficiency, and to extend the lives of these very expensive blades. For this dual rotation the water supply and nozzles should be available from either end. Both may be used simultaneously, or means may be provided to switch from one to the other. The nozzle or nozzles should be wide enough, or multiple nozzles may be used, to cover the width of the blades in either direction.

An additional, smaller brace, 50 is shown here to support a nozzle 52, that rides on wheels 54, to hold it in a constant relationship with the pavement 16. The nozzle is fed by a hose 56 connected to a supply of compressed air, not shown, that can also be mounted on the truck.

After the hole is cut to the prescribed depth, and it may be still partially filled with debris, sludge, and water, this nozzle is moved up to the edge of the hole, and it directs compressed air, at the correct angle and pressure to clean all of the debris, and even the water, out of the hole so that the reflector unit can be fitted into the hole and secured.

The reflective elements must be just high enough to catch and reflect light from headlights, but not high enough to be damaged by snow plows or excessive tire wear. There are many types of units of varying sizes and shapes to cover as many situations. The cutting blades must be matched to the units or vice-versa. The unit must be fitted, levelled, and glued into the pavement while the cut is still clear.

FIG. 4 shows a front view, in partial cross section, of a plunge cut saw similar to the device of FIG. 3. The plunge cut saw 30 is seen, with motor 32 driving the cutters into the road surface 16.

In practice, for one common reflector unit, the cutters comprise at least 2 outer pairs of blades 36A and 36B, of a larger diameter than the bulk of the inner blades 38. For example, the outer blades 36A and 36B would normally be 20 inches in diameter while the inner blades 38 are 18 inches in diameter. The cutting blades here are ¼ inch thick. In a typical cut, there should be enough blades to provide a width of five inches within the cut. In this case, two are needed for each of the outer blades 36A and 36B, and fifteen are needed for the inner blades 38. The blades and motor and mounting are designed, in this case, to permit a cut of a depth up to four inches within the pavement.

While the pivot 42 allows the bracket 40, with its extension 46, seen most clearly in FIG. 3, to move up and down with the plunge cut saw that cuts into the surface of the pavement, the pavement may not always be level, or parallel with the braces mounted on a vehicle, There must, of course, be a crown, or curve for the surface of the pavement to shed water during heavy rains, and that also lets the rain water carry off dirt and light debris. It is obvious that the ideal cut should be perpendicular to the surface of the road, rather than the level of the braces of the vehicle.

This machine is, therefore, provided with a second degree of motion, shown in FIGS. 3 and 4, with a pivotable rod or shaft 44, substantially parallel to the pavement and along the axis of the road. This pivotable rod couples the brace 46 to the brace 40, and may have a pillow block unit that allows the brace 46 to be rotated with respect to ground level to bring the cutters 34 of the plunge cut saw perpendicular to the surface of the pavement wherever a cut is to be made. This is quite important, since the reflector unit that is to be inserted in the pavement must be level with the surface of the pavement to be most effective, and to avoid physical harm to the unit. Obviously, the brace 46 should be locked with respect to the brace 40 before the cutting begins.

The simple, typical, pivot 44 shown here to provide for motion of the cutter with respect to the surface of the pavement, is shown between the braces 40 and 46. However, it is obvious that the pivot can be positioned anywhere along the brace 26, or any projection of the brace 28. Only a slight degree of motion will be needed, and the important thing is to have the whole bracing structure in alignment and rigid during the cut.

A rudimentary sliding arm brace, such as 24, will normally be enough to permit movement of the cross braces, such as 26, although, since it must be a heavy structure, some mechanical help will probably be needed to help move it in and out. Any conventional mechanism, from levers to screws to hydraulic jacks would be applicable here, and wheels or roller bearings would make it easier. In any case, a locking mechanism should be provided to hold the bracing mechanism for the cutter rigidly in position during the cut.

If the vehicle is not heavy or steady enough, jacks of conventional types, not shown, may be used on the sides of, or the corners of the vehicle to hold it in a more rigid position during the cut. In addition, the bracing structure, including 28 for example, may be designed to rest on the pavement itself to seek its own level and establish it own reference for depth, as well as being locked to the bracing mechanism. This will further insure that the plunge cutter will be level and reach a precise and consistent depth for each cut. It is, again, essential that each reflective unit be level with the surface of the road and just beep enough to avoid damage by, or damage to, snow plows or the like.

The driving motor 32 can be of any type that can supply enough power to make the cuts in the pavement quickly and cleanly. It may be electric, or hydraulic, or gas driven. The blades can even be driven by the engine of the truck.

A water tank, not shown, could also be mounted on the truck, and would be an obvious way of supplying water to the input 50. On the other hand, hoses, connected to a local water supply, with or without pumps would, obviously, be equivalent.

Similarly, an air compressor and compressed air storage tank can also be mounted on the vehicle to supply compressed air to the input 56 for clearing out the newly-dug hole in the pavement before the reflector unit is fitted and secured.

It may be noted that, while the basic units are secured into the pavement in a fairly permanent manner, they could be pried out of their holes for replacement. New holes could also be cut for other units. However, the basic units are usually of cast iron or other very durable material, and fitted into their holes in a manner that makes damage or breakage unlikely. The reflector elements themselves, on the other hand, will likely be of plastic, and, while well protected by the casing of the basic units, to minimize damage, they should be replaceable. New elements can be inserted to replace damaged units, for improved visibility, or to change the color or the direction of the reflective elements.

I claim:

1. A machine for cutting holes in a road surface for mounting reflective safety units comprising a vehicle to be moved along a road way, for supporting said mechanism; at least one lateral, fixed support member extending across said vehicle substantially perpendicular to the direction of said road way; at least one movable support member supported by said fixed support member and movable with respect to and in the direction of said fixed support member; a rigid brace secured to the end of said movable support member; a circular cutting tool pivoted to said rigid brace and movable up and down with respect to said road surface; means for moving said circular cutting tool up and down with respect to said road surface for cutting said road surface; means for directing a stream of water at said cutting tool as it cuts said road surface; and means for directing a stream of compressed air at a newly-cut hole in said road surface to clear it of debris and water.

2. A machine for cutting holes in a road surface as in claim 1, having means for rotating said circular cutting tool about an axis parallel to said direction of said road way, whereby said circular cutting tool can be adjusted to be perpendicular to said road surface before said circular cutting tool is moved down into said road surface.

3. A machine for cutting holes in a road surface, as in claim 1, having two lateral, fixed supports, one in each direction, extending across said vehicle substantially perpendicular to said direction of said road way; two movable support members. One in each direction, supported by said fixed support members, and movable with respect to and in the directions of said fixed support members; two rigid braces secured to the ends of said movable support members; and two circular cutting tools pivoted to corresponding ones of said rigid braces, for cutting holes in said road surfaces on either side of said vehicle simultaneously.

4. A machine for cutting holes in a road surface, as in claim 1, having at least two lateral, fixed support members extending across said vehicle, substantially perpendicular to said direction of said road way; at least two movable support members supported by said fixed support members, and movable with respect to and in the direction of said fixed support members; said rigid brace being secured to the ends of said movable support members.

5. In a machine for cutting holes in a road surface, as in claim 1, said circular cutting tool comprising a series of circular, abrasive, cutting blades mounted adjacent to each other on a common shaft for cutting a wide hole in said road surface.

6. A machine for cutting holes in a road surface, as in claim 5, wherein said abrasive cutting blades are at least one quarter of an inch thick and eighteen inches in diameter.

7. A machine for cutting holes in a road surface, as in claim 6, having at least two blades, on each side of said series of eighteen inch cutting blades, of a diameter of twenty inches to provide a deeper cut and grip into said road surface for edge of said reflective safety units.

8. A machine for cutting holes in a road surface, as in claim 1, having means for reversing the direction of rotation of said circular cutting tool to utilize less worn abrasive materials in the opposite direction of rotation.

* * * * *